US006065190A

United States Patent [19]

Mandl et al.

[11] Patent Number: 6,065,190

[45] Date of Patent: May 23, 2000

[54] STATIONARY FLAT SYSTEM FOR CARDING MACHINES

[75] Inventors: Gerhard Mandl, Strehlgasse 8, CH-8311 Brütten; Hans-Peter Meile, Winterthur, both of Switzerland

[73] Assignee: Gerhard Mandl, Switzerland

[21] Appl. No.: 09/313,484

[22] Filed: May 17, 1999

[30] Foreign Application Priority Data

May 18, 1998 [EP] European Pat. Off. ..... 98 810 451

[51] Int. Cl.[7] ..... D01G 15/76

[52] U.S. Cl. ..... 19/107; 19/98; 19/109

[58] Field of Search ..... 19/98, 99, 102, 19/103, 104, 107, 108, 109, 110, 111, 113, 114

[56] References Cited

U.S. PATENT DOCUMENTS

| | | | |
|---|---|---|---|
| 2,879,549 | 3/1959 | Miller et al. | 19/104 |
| 4,972,552 | 11/1990 | Graf | 19/113 |
| 5,031,278 | 7/1991 | Demuth et al. | 19/98 |
| 5,228,170 | 7/1993 | Giuliani | 19/113 |
| 5,398,381 | 3/1995 | Schlichter et al. | 19/102 |
| 5,530,994 | 7/1996 | Loeffler | 19/109 |

FOREIGN PATENT DOCUMENTS

| | | | |
|---|---|---|---|
| 0388791A1 | 9/1990 | European Pat. Off. | D01G 15/34 |
| 068754A2 | 12/1995 | European Pat. Off. | D01G 15/24 |
| 9419619 | 3/1995 | Germany | D01G 15/08 |
| 2003202 | 3/1979 | United Kingdom | D01G 15/82 |
| WO89/00214 | 1/1989 | WIPO | D01G 15/80 |

OTHER PUBLICATIONS

Patent Abstracts of Japan Pub. No. 07102425; Pub. Date Apr. 18, 1995.

Patent Abstracts of Japan, Pub. No. 58163731 A; Pub. Date Sep. 28,1983.

*Primary Examiner*—Michael A. Neas
*Assistant Examiner*—Gary L. Welch
*Attorney, Agent, or Firm*—Webb Ziesenheim Logsdon Orkin & Hanson, P.C.

[57] ABSTRACT

A carding machine has a cylinder (3), stationary, self-cleaning flats (2) fixed at a chain (45) and guided and adjusted by a flexible bend (48). Additional active trash, dust and short fibre extraction units (1) are placed in the main carding zone. The units (1) are constructed as separate units, removable and placeable, instead of stationary flats (2), between adjacent flats (2). The units (1) have the same principal width gauge as the flats (2) or a multiple of it. The units (1) are fixed and held the same way as the flats (2) by the chain (45) and the flexible bend (48). The machine achieves an excellent carding quality and is readily adjustable to different needs.

20 Claims, 6 Drawing Sheets

STATIONARY FLAT SYSTEM FOR CARDING MACHINES

BACKGROUND OF INVENTION

The present invention relates to carding machines with a main cylinder, lickerin and doffer, comprising self-cleaning stationary flats with dust and trash extracting units in the main carding zone.

Conventional carding machines use revolving flats that move around the peripheral surface of the upper part of the carding cylinder. Revolving flats are in general use for cotton carding because their flats can be cleaned when they are not opposing the surface of the carding cylinder.

Cards equipped with revolving flats suffer from several disadvantages:

- Only a small number of the revolving flats is in the working zone. The revolving flats have only a temporary carding function as long as they pass over the working zone. The bigger part of the revolving flats is permanently not in a carding function. Therefore, the revolving flat card needs a large number of flats that are ineffectively used, cause higher costs and do not contribute to the carding effect.
- During their passage on the surface of the carding cylinder the clothings of the revolving flats become loaded with extracted material. For a large part of the working cycle therefore the carding efficiency of the revolving flats is considerably reduced or even ineffective.
- Each of the flats of the revolving card passes over the whole main carding zone and does not stay at a specific position. Therefore, all the flat clothings have to be identical to obtain a regular carding effect. A better carding effect is obtained with rougher flat clothings at the beginning and with finer flat clothings toward the end of the main carding zone, which is not possible with revolving flats.
- The bars of the revolving flats drag continually on the flexible bend, which guides the flats in the desired distance to the surface of the cylinder. The flexible bend, an important and expensive part of the revolving flat card, and the flats themselves suffer from considerable wear and tear which causes high maintenance costs.
- The revolving flat card requires a complicated construction for driving, guiding and cleaning which induces high costs for manufacturing and maintaining this type of card.

These above described disadvantages gain importance when higher card productions are maintained.

Several attempts have been undertaken to overcome these described disadvantages of the revolving flat card, the most important are the following:

One of those attempts consists in improving the incomplete carding effect of the revolving flats by installing supplementary dust and trash removing devices on the cylinder surface outside the main carding zone. The major disadvantages of such approaches are:

- The additional elements do not remove the technological and mechanical disadvantages of the revolving flats in the main carding zone except that they subsequently compensate partially for their imperfect carding effect.
- Those additional elements further complicate the construction of the card and increase its manufacturing and maintaining costs.

Another attempt to overcome the disadvantages of the revolving flat card consists in more radical solutions that replace the revolving flats by stationary flats. Stationary flats entirely replace their revolving counterparts, they are rigidly fixed to the main frame around a portion of the main cylinder and they do not move.

Stationary flat cards have some major advantages:

- Cards with stationary flats are built without moving parts in the main carding zone beside the main cylinder. A simple general design and construction are therefore possible, which results in lower manufacturing and maintaining costs.
- All the stationary flats are permanently active in the working zone. Therefore, fewer flats are needed in comparison to the revolving flat card. All the flats can be permanently used.
- There is no motion of the bars of the stationary flats on the flexible bend, therefore wear and tear of those elements are avoided.
- No supplementary flat cleaning devices outside the main carding zone are necessary.

The flat clothings can be adjusted to their position in the main carding zone. Rougher clothing's might be positioned at the beginning and finer clothings toward the end of the main carding zone.

- The flat position relative to the main cylinder can be individually set, thus additionally optimising the carding quality.

Several approaches have been proposed to construct a stationary flat card, but each with some more or less severe disadvantages:

U.S. Pat. No. 2,879,549 (1957) herein incoperated by reference uses a flexible bend to adjust the distance of the stationary flats to the cylinder surface. No extraction or cleaning devices are described. The stationary flats are not equipped with any wiring, clothing or such. A card like that will not result in sufficient carding quality of the passing staple fibres. Self-cleaning of the flats is claimed by the card wind in the sealed chamber of the whole main carding zone and by the replacement of the steel wire clothing of the flats with a non-loading, rigid, abrasive granular surface. No supply air from outside the card is used. As claimed, the extracted material has to pass under high pressure through the entire main carding zone. The state of the art is a flat clothing of steel wire or hooks, which is proven as inevitable for proper carding performance. The prescribed design severely impairs with the carding effect and therefore could not gain any attention in mill practice.

JP-A-58-163731 A (1983) uses stationary flats fixed at a chain and on the flexible bend. Mote knife-like projections at the side of the flats and side clips, forming dust-sucking ducts, are used to separate dust, trash and short fibres and to remove them by the card wind after each flat. The details of design are not further specified. The main disadvantages of this solution are: no supply air from the outside of the carding zone is used, so that the exhaust air is not compensated. This induces distortion of the card wind and impairing the carding effect of following flats. The mote knife and the suction duct of separate attached parts at each flat require a complicated construction. The separate adjustment of the mote knifes of each flat is laborious and therefore impracticable for the use in mills.

WO-A-89/00214 (1989) describes a waste removing device after the main carding zone of a revolving flat card, a mote knife, an air guiding plate, a sharp edge and supply air from outside the card together with the card wind to extract and remove remaining waste and short fibres from the cylinder surface. This solution uses a self-regulating air-stream with supply air and exhaust air. Being positioned after the main carding zone, it can work as extraction device neither for revolving nor for stationary flat clothings in the main carding zone. Being positioned after the main carding zone the device has no significance to the carding effect in the main carding zone. The design and shape of this extracting device make it non-applicable between flats in the main carding zone.

U.S. Pat. No. 5,530,994 (1996) primarily claims a blade for trash removal with a rounded edge of a radius greater than 1 millimetre. Specially designed and shaped flats are shown, which differ from standard flat design. Extraction and removal devices between two stationary flats are shown. The exhaust air with the extracted dust, trash and fibres is removed laterally at one side of the extraction device, which requires eventually a pneumatic suction device. Each stationary flat is fixed directly to the main frame. The separate parts of the extraction device have to be adjusted individually for every flat which needs time and causes high adjustment costs.

The straight blade for the mote knife together with the rounded edge does not give the optimum extraction effect as tests show.

Supply air and exhaust air has to be regulated by adjustment means. The removal of the extracted material at the side of the extracting device might lead to an asymmetric extraction effect and thus should be avoided. The eventual need of a pneumatic suction device causes higher manufacturing and working costs. As each flat is fixed separately at the main frame of the card no common adjustment of the distance of the flats to the cylinder surface is possible.

SUMMARY OF THE INVENTION

The present invention avoids the above described drawbacks of the stationary flat system and offers full use of the inherent advantages. The invented flat system makes optimum use of the card wind, the fast moving air stream induced by the clothing of the main cylinder. Beside excellent carding quality the system offers a very effective extraction of trash and dust, the system being readily adjustable to the specific needs of a mill. In addition the invention gives an economical solution for manufacturing and setting the flat system. The necessarily accurate settings of the flats are easily achieved which is of considerable help in mill practice. The design uses standard card parts to a large extent, which reduces manufacturing costs.

BRIEF DESCRIPTION OF THE DRAWINGS

The invention is explained by examples in the following schematic drawings. These show.

DETAILED DESCRIPTION OF THE PREFERRED EMBODIMENT

Figure 1:
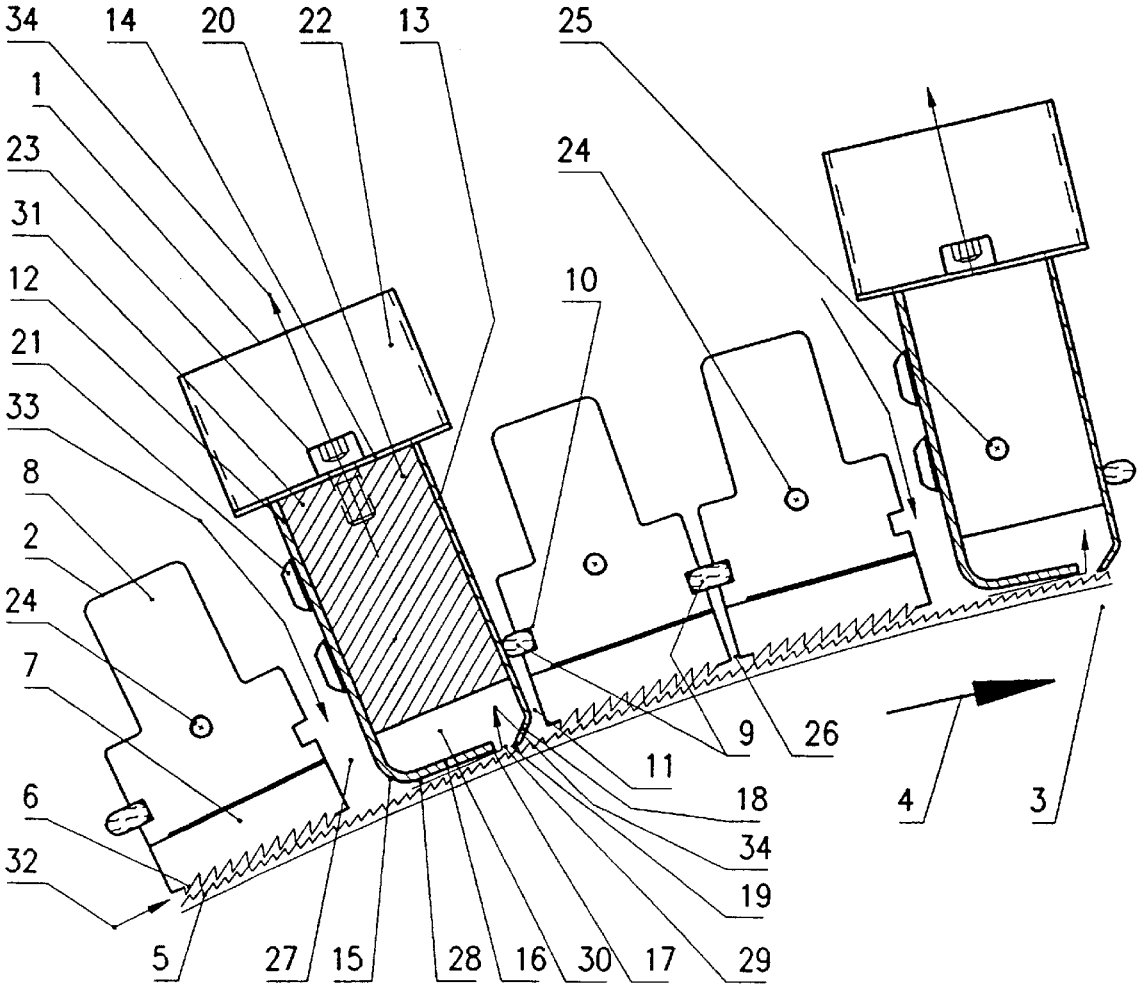
FIG. 1 is a side-view of an active extraction unit and the adjacent flats.

FIG. 1 shows a side-view and partial cross-section of the main elements. The active extraction unit 1 is positioned in-between the stationary flats 2 above the main cylinder 3 with the rotating direction 4. The surface of the cylinder 3 is covered—for example with a saw teeth clothing 5. The saw teeth are bevelled in the rotating direction 4 of the cylinder 3. The flats 2 consist of the bar 8 and the carrier 7 to which the flat clothing 6 are fixed. As indicated the flat clothing 6 might be made out of metallic wires, also indicated as 6. The teeth of the metallic wires 6 are orientated against the rotating direction of the cylinder 3. As an alternative to the rigid metallic wires 6 flexible clothing might be used instead. The carding effect between the flat clothing 6 and the saw teeth of the cylinder surface 5 is regulated by the specifics of the clothings and by finely adjusting the distance between the flat clothing 6 and the cylinder clothing 5. The staple fibres (not shown) are carded in a standard way between the cylinder clothing 5 and the flat clothing 6.

The cylinder 3 with a standard diameter of about 1.2 m is running at 300 to 500 revolutions/min. in the direction 4. For example at 400 revolutions/min. The circular velocity of the cylinder clothing 5 amounts to approximately 25 m/sec. Thus the fast running cylinder creates a strong air stream on its surface in the direction 4, the so called card wind 32.

The extraction unit 1 is shown as a compact structure without direct connection to the adjacent flats 2. The rubber seal 9 is inserted in the side grooves. The rubber packing or seal 9 touches the therefore neighboring extraction unit 1 or the flat 2 to seal the gaps 11 and 26. The sealing of the gaps 11 and 26 prevents the card wind 32 from escaping through the said gaps.

FIG. 1 further explains the design of the extraction unit 1. The compact casing of the extraction unit 1 consists of the side sheets 12, 13, the cover plate 14 and the central bar 20. Screws 21 fix the side sheets 12, 13 laterally to the central bar 20. Screws 23 fix the cover plate 14 to the central bar 20 on both sides of the suction hood 22. Central bar 20 and side sheets 12, 13 form mutually the exhaust air channel 30. The side sheet 12 together with the opposite side of the adjacent flat bar 8 defines the supply air channel 27.

The rounded edge 15 of the side sheet 12 acts as air flow and fibre deflector. Section 16 of the side sheet 12 acts as hold-down means for the fibre material against the clothing 5 of the cylinder 3. The angular bent section of the side sheet 13 with the acute-angled edge 19 serves as mote knife 18 that extracts trash and short fibres from the carded fibre material. Thus the working parts of the side sheets 12, 13 (the rounded edge 15, the hold-down section 16 of the side sheet 12, and the mote knife 18 with the acute-angled edge 19 of the side sheet 13) are integrated sections of these side sheets. Each of the side sheets 12, 13 consists of a sheet metal of approximately 0.5 mm to 3 mm width.

A special feature of the invention is the position of the inserted extraction units 1: the extraction units 1 have the same principle width as the flats 2. This means that the width of an extracting(unit 1 plus the width of the supply air channel 27 equals the width of a flat 2 plus the width of one gap 26 between two flats 2. The distance between the fixation points 24 of two adjacent flat bars 8 equals the distance between the fixation point 25 of the extraction unit 1 and the fixation point 24 of an adjacent flat bar 8. This same principle width of the extracting units and the flats allows the replacement of flats by extraction units and vice versa as desired.

In mill practice the extracting effect of the extraction units 1 has to be adjusted according to the specific material processed and the quality parameter needed. For this purpose the compact extraction units 1 can be replaced by exchange of extraction units with different dimensions of the side sheets 12, 13 acting as hold-down means 16 and mote knife 18. Such an exchange of the extraction units allows a more accurate overall adjustment of the distance of the hold-down means 16 and the edge 19 of the mote knife 18 to the surface of the cylinder 3 than the individual adjustment of several separate working parts of a non-compact extracting device. The exchange of the whole extraction unit 1 is also much less labour-intensive than the adjustment of an extraction device, whose separate parts have to be adjusted individually to change the extraction effect.

The air flow is of great importance for the proper function of the entire system. The supply air 33 is sucked by the card wind 32 through the supply air channel 27 to the rounded edge 15 of the side sheet 12. The supply air 33 is then accelerated by the nozzle effect in the narrowed passage 28 between the hold-down section 16 and the clothing 5 on the surface of the cylinder 3. This acceleration of the air stream at the passage 28 reinforces the removing effect of the air stream to dust, trash and short fibres which are subsequently separated from the good fibres. The good and usable fibres remain in the clothing 5 while trash and dust are removed by the acute-angled edge 19 of the mote knife 18 of the side sheet 13.

The extracted material is then sucked away in the exhaust air 34 through the exhaust gap 29 between the edge 17 at the end of the hold-down section 16 and the acute-angled edge 19 at the end of the mote knife 18, through the exhaust air channel 30, through the outlet 31 and the suction hood 22. The edge 17 of the hold down section of the side sheet 12 is a straight edge, treated free from fibre sticking.

The extraction unit 1 can be characterised as active because the whole air stream—from the supply air 33 to the exhaust air 34, which carries the extracted material through the exhaust gap 29, the exhaust air channel 30 and the outlet 31—is generated, driven and maintained by the card wind 32. No additional mechanical or pneumatic ventilation or suction device is necessary to activate this air stream and thus to extract dust, trash and short fibres in the main carding zone and to remove the extracted material. Therefore, the extraction units according to this invention are called as self-ventilating.

The extraction unit 1 extracts and removes the dust, trash and short fibres from the narrow passage 28 through the exhaust gap 29 to such a degree that only the card wind 32 and good fibres in the saw teeth clothing of the cylinder surface 5 pass to the carding zone of the next flats 2 in the cylinder rotating direction 4. The clothing's 6 of the flats 2 after the extracting unit 1 do not become loaded with dust, trash and short fibres and act therefore with their full carding effect. No other cleaning devices are necessary for the cleaning of the clothing's 6 of the stationary flats 2. Therefore, the present invention realises a self-cleaning card with stationary flats 2 by the active extraction units 1.

The volume of the supply air 33 entering into the extraction unit 1 equals the volume of the exhaust air 34 leaving the extraction unit 1. This is attained without additional regulating devices for the supply air 33 at the supply air channel 27 or for the exhaust air 34 at the outlet 31. This self-regulation of the exhaust air stream 34 is effected by the volume and the shape of the exhaust air channel 30.

Because the supply air 33 to the extraction unit 1 equals the exhaust air 34, the air stream 33, 34 through the extraction unit 1 does not interfere with the air stream of the card wind 32. Thus the card wind 32 passes under the extraction unit 1 without distortion and streams further to the next flats 2. The self-regulation of the supply air 33 and the exhaust air 34 and their non-interference with the card wind 32 are essential for an optimal downstream carding effect of the next flats and for the extracting effect of the following extracting unit 1.

Figure 2:
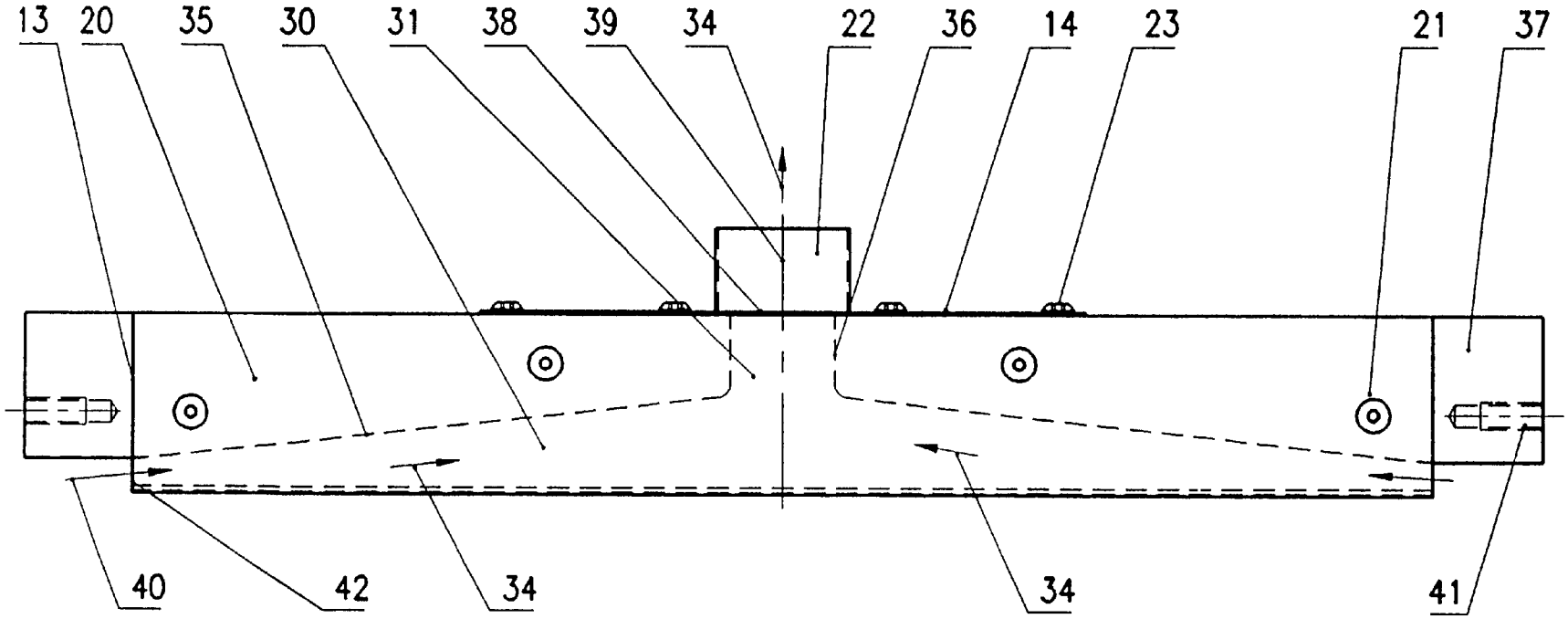
FIG. 2 is a front-view of the active extraction unit.

FIG. 2 shows the front-view of the extraction unit in the opposite direction to the cylinder rotating direction 4. The side sheet 13 is laterally fixed to the central bar 20 with numerous screws 21. The central bar 20 consists of massive Aluminium. The screws 23 fix the cover plate 14 to the top of the central bar 20. The hole 38 is positioned at the lateral centre 39 of the extraction unit, where the suction hood 22 is joined to the cover plate 14 over the hole 38.

FIG. 2 shows the compact structure of the extraction unit as a special feature of the present invention. This compact structure of the extraction unit consist substantially of only three main elements: the central bar 20, the side sheet 12 (not shown), and the side sheet 13. The end part 37 of the central bar 20 contains the fixation screw 41 that fixes the extraction unit to the chain (not shown). The under surfaces 35 of the two central bars 20 serve as cover of the exhaust air channel 30. The inner surfaces 36 of the two central bars 20 build the side covers of the outlet 31. The extraction unit contains no movable parts. Each of its few main parts serves for different functions. All parts of the extraction unit have shapes that are easy to manufacture.

The exhaust air 34 sucks away the extracted dust, trash and short fibres over the whole length of the exhaust air channel 30, which equals the carding width of the clothing on the cylinder surface. The exhaust air 34 streams through the exhaust air channel 30 and then out of the extraction unit through the outlet 31 and the hole 38 into the suction hood 22. The outlet 31 and the suction hood 22 are positioned at the lateral centre 39 of the extraction unit. Therefore, the exhaust air 34 is focused to a continued air stream that further removes the extracted material out of the extraction unit.

The exhaust air channel 30 acts as a suction chamber to the exhaust air 34. The volume and the shape of the suction chamber are chosen so that the exhaust air 34 does not interfere with the air stream of the card wind, and that the exhaust air 34 optimally removes the extracted material. If the volume of the suction chamber of the exhaust air channel 30 is too big, the air stream becomes too slow to remove the extracted material. If the volume of the suction chamber of the exhaust air channel 30 is too small, the volume of the exhaust air 34 is not sufficient to remove all the extracted dust, trash and short fibres. Additional supply air 40 may be provided optionally from the outside of the card through the inlet 42 into the exhaust air channel 30. The inlet 42 would then be positioned at both sides of the exhaust air channel 30 to secure a symmetrical provision of additional supply air 40.

Figure 3:
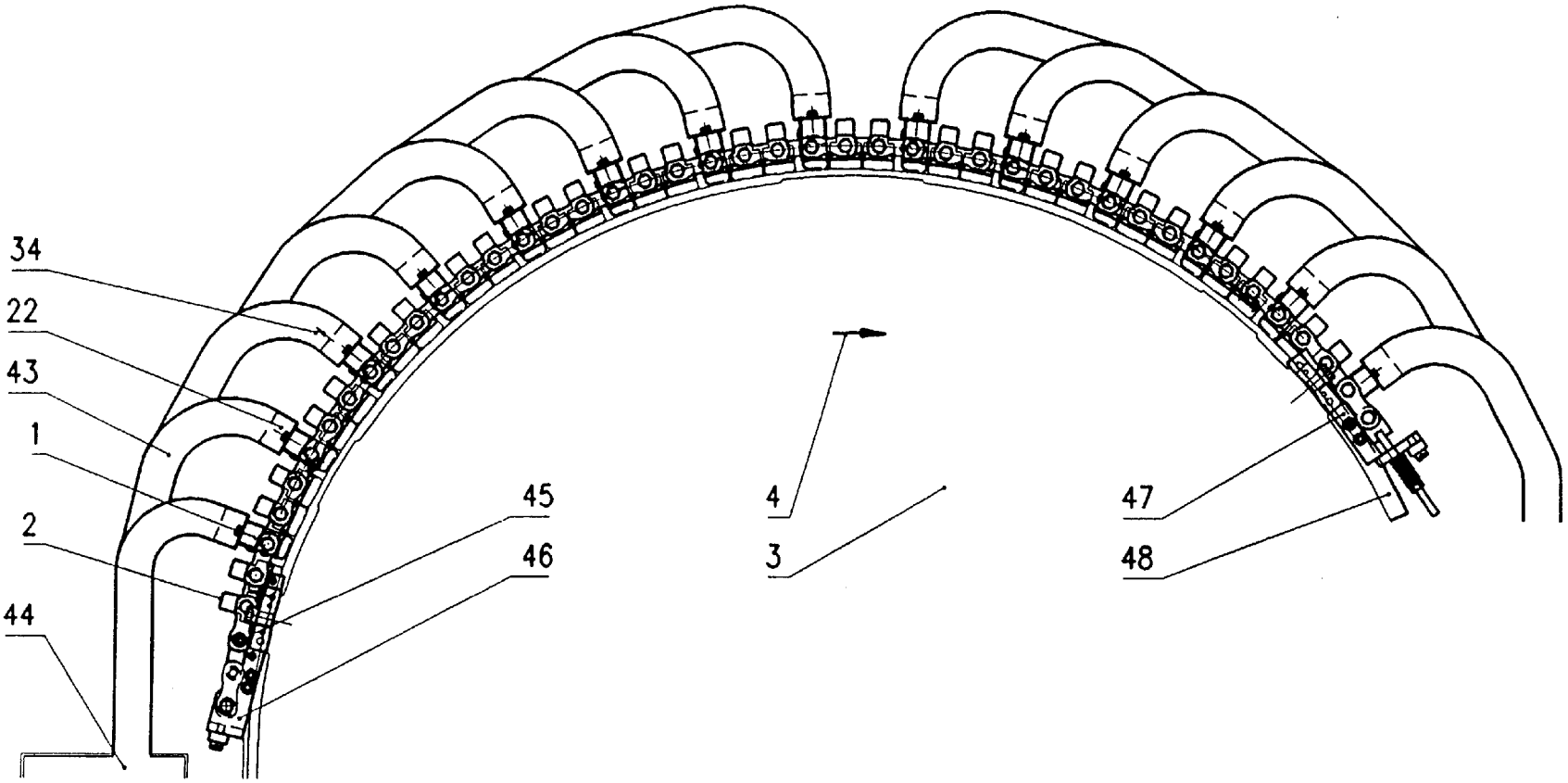
FIG. 3 is a side-view of the main carding zone.

FIG. 3 shows an example of the main carding zone with a configuration of one extraction unit 1 after each group of two stationary flats 2. In this example 28 stationary flats are continually and completely cleaned by 14 extraction units 1. These 28 flats are therefore permanently in optimal carding action.

As explained, each extraction unit 1 is fully interchangeable with any flat 2. Therefore, any other configuration of the system is possible, as required for an optimal carding and cleaning effect in the main carding zone. By this the carding effect in the main carding zone is so effective, that in most cases no supplementary carding or extracting device is necessary before or after the main carding zone. This contributes further to an uncomplicated and economic construction of the card with self-cleaning stationary flats, reducing its manufacturing and operation costs.

A removal hose 43 is fixed at the suction hood 22 of each extraction unit 1. The removal hoses 43 lead to the central collecting hose 44. The exhaust air 34 removes dust, trash and short fibre out of every extraction unit 1 through the suction hood 22 and the removal hose 43 into the collecting hose 44.

The extracted material is completely collected and removed from the main carding zone in a closed circuit. No flying dust, or short fibres leave the main carding zone sidewise or over the top of the flats. Therefore, the pollution of the card by flying dust, trash and short fibres from the main carding zone is prevented. This saves a substantial part of the otherwise necessary manual card cleaning and prevents card operation stops for manual cleaning of the respective card elements. The costs for periodical manual cleaning of the card are thus substantially reduced. This further reduces carding operation costs because periodical machine stops for manual cleaning are reduced to a large extent.

The chain 45 is conventional for revolving flat cards. The described invention uses the chain 45 to hold the flats 2 as well as the extraction units 1 tangential and to pull them against the flexible bend 48. The flexible bend 48 keeps the flats 2 and the extraction units 1 radial in the desired distance from the surface of the main cylinder 3. The main cylinder 3, rotating in the direction 4, presses the flats 2 and the extraction units 1 away from its surface and thus against the chain 45.

These counteracting forces of the main cylinder 3 rotating in the direction 4, of the chain 45 and of the flexible bend 48 allow to adjust with great precision the desired distance of the flats 2 and of the extraction units 1 to the surface of the main cylinder 3. The adjustable flexibility of the flexible bend 48 per segment allows distinctive adjustments of this distance for groups of flats 2 and extraction units 1 at different segments of the flexible bend 48. Such a precise and differentiated adjustment of the distance of the flats 2 and the extraction units 1 to the surface of the main cylinder 3 is essential for an optimal carding and cleaning effect.

The chain 45 extends over the whole main carding zone and is tensioned between the back support 46 and the front support 47. The chain 45 and the flexible bend 48 allow a common adjustment of the distance to the cylinder surface of all the flats 2 and extraction units 1 in the main carding zone by a few simple manipulations. Thus the separate adjustment of each flat 2 and of each extraction unit 1 is replaced by a time saving common adjustment operation for the whole main carding zone with the chain 45 and the flexible bend 48. This saves a lot of time and costs for the individual adjustment of each flat 2 and extraction unit 1 to the cylinder 3, that is only possible when the card operation is stopped. Therefore, the common and simple adjustment of all the flats 2 and extraction units 1 in the main carding zone considerably reduces downtime of the card and thus its operation costs.

Figure 4:
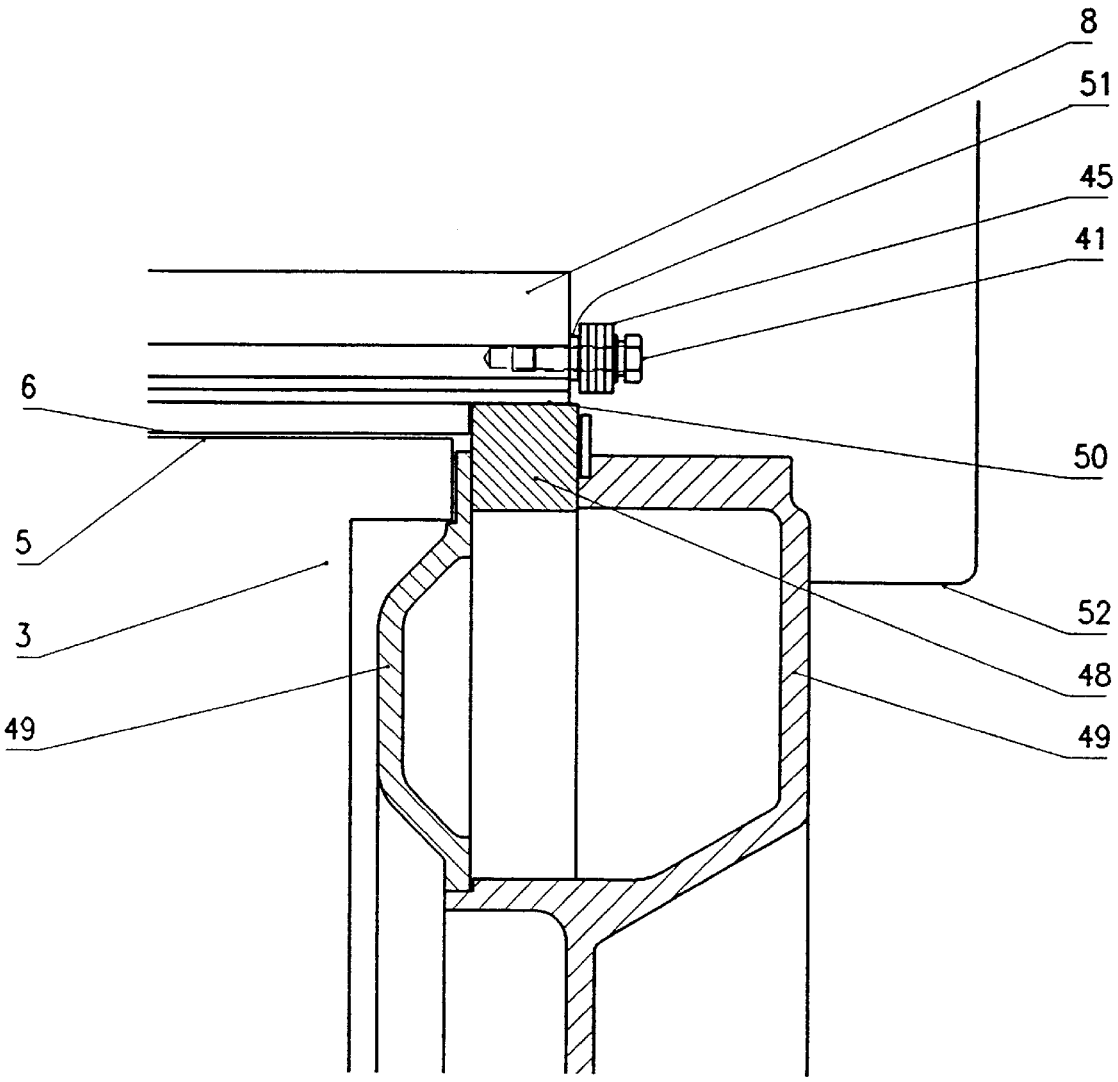
FIG. 4 is a cross-section of the fixation zone of a flat.

FIG. 4 gives details of the fixation of the flat 2. The fixation screw 41 in the bolt 51 fixes the flat bar 8 at the chain 45. The flat bar 8 lies on the upper surface 50 of the flexible bend 48, which is radially adjustable at the main frame 49. This allows the conventional adjustment of the distance of the flat clothing 6 to the surface 5 of the main cylinder 3 with the flexible bend 48. The main carding zone is covered by the card cover 52.

Figure 5:
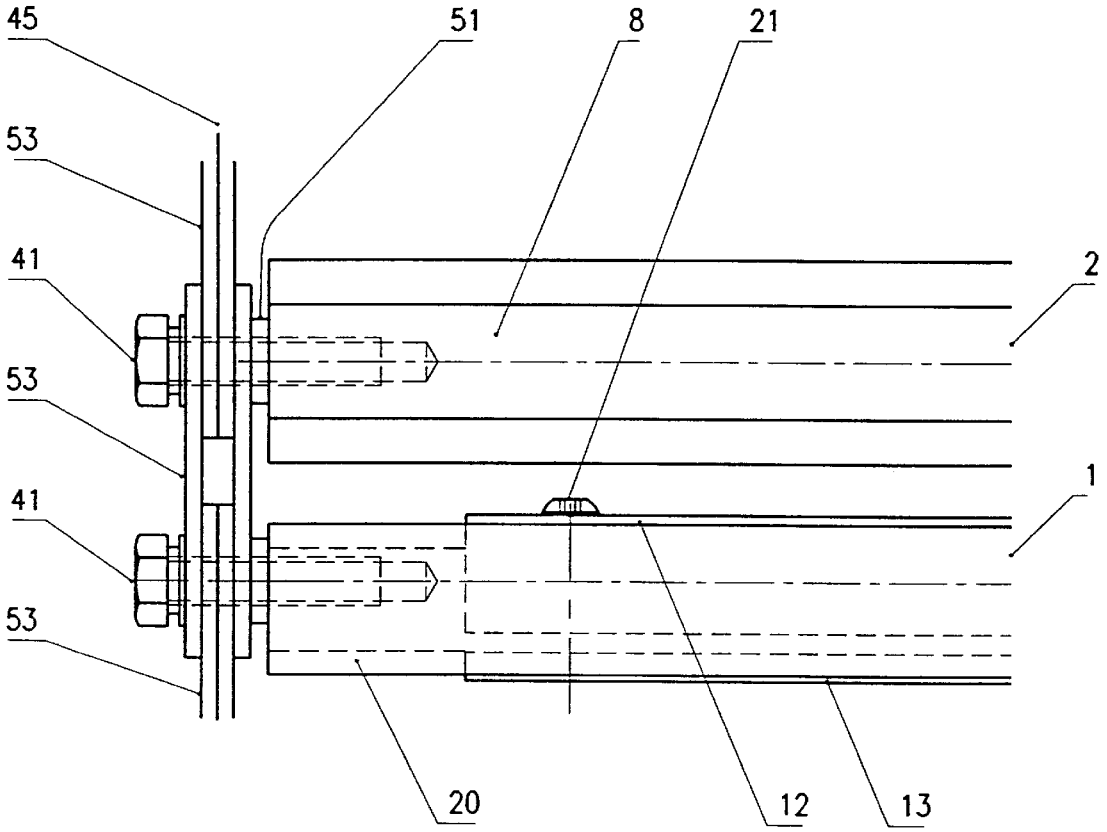
FIG. 5 is a top-view of the fixation of a flat and an extraction unit at the chain.

FIG. 5 shows further details of the fixation of an extraction unit 1 and a flat 2 at the chain links 53. The bolt 51 is inserted into the link hole of two overlapping chain links 53. The fixation screw 41 through the bolt 51 in a groove, either in the bar 8 of the flat 2 or in the central bar 20 of the extraction unit 1, connects the flat 2 or the extraction unit 1 with the chain links .53. Thus the flat 2 and the extraction unit 1 are fixed with the described identical means at the chain links 53 of the standard chain 45. Therefore, it is possible to replace flats 2 by extraction units 1 in a simple operation.

The top-view of the extraction unit 1 in FIG. 5 shows also the lateral fixation of the side sheets 12, 13 to the central bar 20 with the screw 21.

Figure 6:
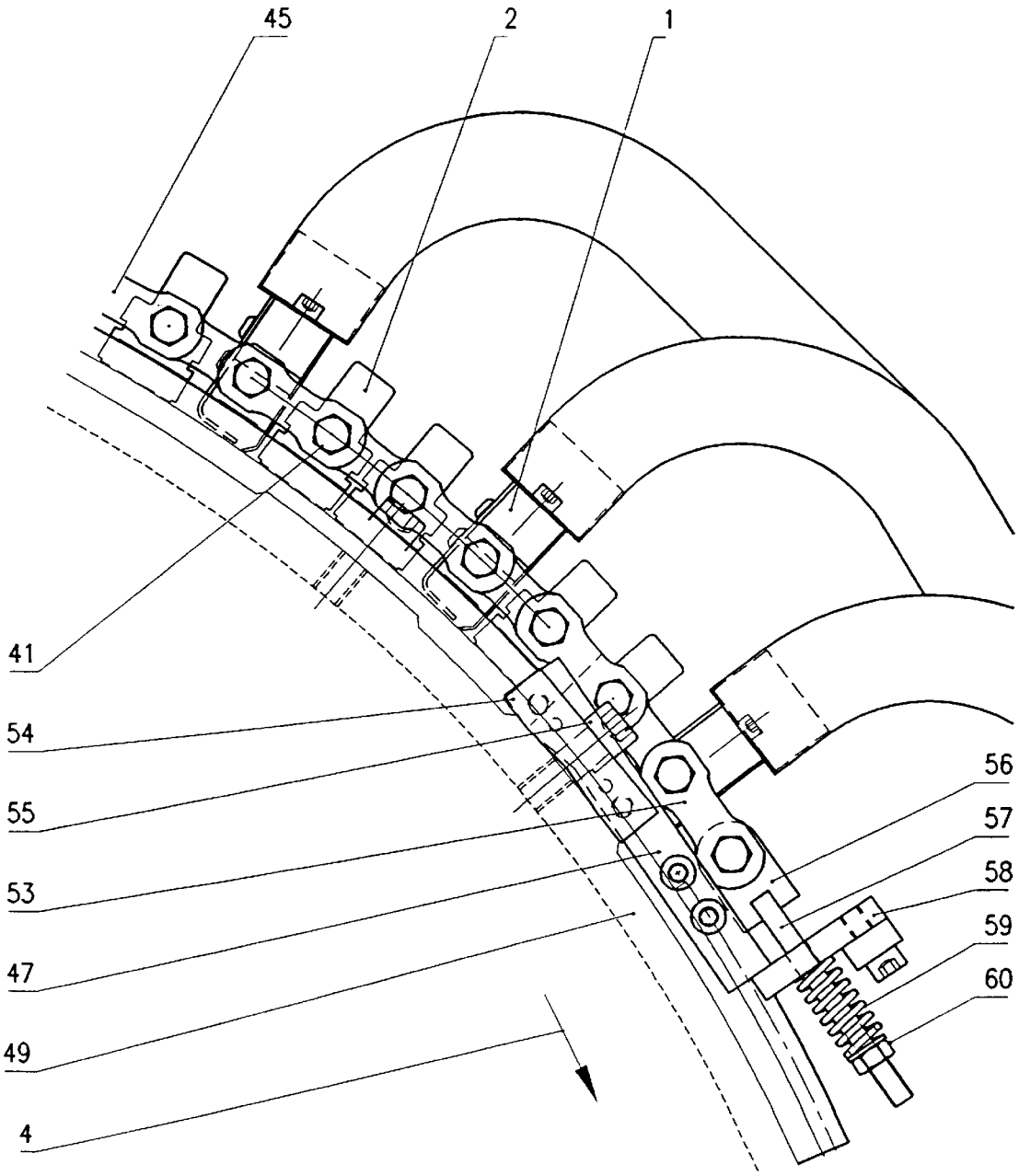
FIG. 6 is a side-view of the tension device of the chain.

FIG. 6 shows the tension device of the chain 45 in detail. The chain head 56 of the tension piece connects the last chain link 53 to the tension piece 57 that passes through a hole in the bow 58 of the front support 47. The base plate 54 fixes the front support 47 with the screw 55 to the main frame 49 of the card. The chain 45 is tensioned by turning the hexagonal nut 60 at the adjustment screw 60 that acts on the tension spring 59. This pulls the tension piece 57 in the cylinder rotating direction 4, thus tensioning the chain 45 over the whole main carding zone. Also shown is the identical fixation of the extracting units 1 and the flats 2 at the chain links 53 with the fixation screw 41.

We claim:

1. A carding machine for processing staple fibres, comprising:

a cylinder; and self-cleaning flats fixed to a flexible tension element, guided and adjusted by a flexible bend, the flats being stationary during operation of the carding machine, wherein active trash, dust and short fibre extraction units are placed in a main carding zone, each extraction unit comprising a suction chamber connected to an exhaust air channel, wherein said extraction units are constructed as separate compact structural units, removable and placeable between adjacent flats of the main carding zone, wherein a width of said extraction units is an integer multiple of a width of the stationary flats, and wherein said extraction units are fixed and held the same way as the stationary flats by the flexible tension element and the flexible bend.

2. A carding machine according to claim 1, wherein said extraction units use a card wind on the surface of the rotating main cylinder to separate, remove, suck away and to transport extracted dust, trash and short fibres in the extraction units.

3. A carding machine according to claim 1, wherein said extraction units comprise a mote knife that is bent towards a fibre flow on the main cylinder.

4. A carding machine according to claim 3, wherein said extraction unit comprises a casing, said casing comprising a first sheet in rotational direction of the cylinder, the first sheet being formed of a plurality of sections serving as a side border of an adjacent suction channel, as a border of the suction chamber inside the extraction unit and as hold-down means and rounded nozzle in the respective cylinder surface zone, and wherein a second side sheet on the casing of the extraction unit in the rotational direction of the cylinder comprises a plurality of sections that serve as border of the suction chamber inside the extraction unit and as mote knife with an edge.

5. A carding machine according to claim 3, wherein a distance of the extraction units to the cylinder surface is adjusted together with a distance of the flats to the cylinder by changing the arc flexion of the same flexible bend for the whole main carding zone, comprising flats and extraction units.

6. A carding machine according to claim 1, wherein the extraction units are adjustable in their distance to the cylinder surface together with the stationary flats of the main carding zone by the flexible bend.

7. A carding machine according to claim 1, wherein said extraction unit comprises a casing, said casing comprising a first sheet in rotational direction of the cylinder, the first sheet being formed of a plurality of sections serving as a side border of an adjacent suction channel, as a border of the suction chamber inside the extraction unit and as hold-down means and rounded nozzle in the respective cylinder surface zone, and wherein a second side sheet on the casing of the extraction unit in the rotational direction of the cylinder comprises a plurality of sections that serve as border of the suction chamber inside the extraction unit and as mote knife with an edge.

8. A carding machine according to claim 7, wherein the side sheets of the casing of the extraction units comprise sheet metal with a thickness of about 0.5 mm to 3 mm.

9. A carding machine according to claim 7, wherein the edge of the mote knife has an acute angle in cross-section.

10. A carding machine according to claim 7, wherein the holding chain is tensioned between a back support and a front support by a spring and by a tension screw attached to a tension piece that is fixed at the front support.

11. A carding machine according to claim 1, wherein the flexible tension element is tensioned between a back support and a front support by a spring and by a tension screw attached to a tension piece that is fixed at the front support.

12. A carding machine according to claim 1, wherein a distance of the extraction units to the cylinder surface is adjusted together with a distance of the flats to the cylinder by changing the arc flexion of the same flexible bend for the whole main carding zone, comprising flats and extraction units.

13. A carding machine according to claim 1, wherein a different adjustment of a distance of the extraction units from an adjustment of the distance of the flats to the cylinder surface is effectuated by replacement of the whole extraction units by exchange extraction units of different dimensions.

14. A carding machine according to claim 1, wherein each extraction unit comprises a supply air channel for removing supplied air intermingled with extracted dust, trash and short fibres.

15. A carding machine according to claim 1, wherein said extraction unit comprises a casing having a side sheet comprising a plurality of sections which form a border of the suction chamber inside the extraction unit and as a mote knife with an edge.

16. A carding machine according to claim 1, wherein the exhaust air channel is located in a lateral centre of the extraction unit.

17. A carding machine according to claim 16, wherein the suction chamber has air entrance openings at both of its axial ends.

18. A carding machine according to claim 1, wherein the flexible tension element is a chain.

19. A carding machine according to claim 1, wherein the suction chamber has an air entrance opening.

20. A carding machine according to claim 1, wherein the suction chamber is open towards the cylinder along an axial length thereof.

* * * * *

UNITED STATES PATENT AND TRADEMARK OFFICE

CERTIFICATE OF CORRECTION

PATENT NO. : 6,065,190

DATED : May 23, 2000

INVENTOR(S) : Gerhard MANDL et al.

It is certified that error appears in the above-identified patent and that said Letters Patent is hereby corrected as shown below:

Column 4 Line 17 "revolutions/min. The" should read --revolutions/min., the--.

Column 4 Line 23 after "grooves" insert --10--.

Column 4 Line 24 before "neighboring" delete --therefore--.

Column 4 Line 53 "extracting (unit" should read --extracting unit--.

Column 5 Line 46 "clothing's" should read --clothings--.

Column 5 Line 50 "clothing's" should read --clothings--.

Column 6 Line 13 "consist" should read --consists--.

Column 4 Line 53 "extracting (unit" should read --extracting unit--.

Column 8 Line 4 ".53" should read --53--.

Signed and Sealed this

Third Day of April, 2001

Nicholas P. Godici

*Attest:*

NICHOLAS P. GODICI

*Attesting Officer*

*Acting Director of the United States Patent and Trademark Office*